United States Patent [19]

Fier

[11] 4,302,126

[45] Nov. 24, 1981

[54] MANHOLE COVER SUPPORT RING

[76] Inventor: Raymond L. Fier, 5323 Pin Oak Ave., NW., Massillon, Ohio 44646

[21] Appl. No.: 106,886

[22] Filed: Dec. 27, 1979

[51] Int. Cl.[3] ..... E02D 29/14

[52] U.S. Cl. ..... 404/26; 52/19; 210/166; 405/142; 248/225.3 A; 403/43

[58] Field of Search ..... 404/26, 25; 52/19; 405/288, 142; 248/225.3 A; 403/43; 210/163, 166

[56] References Cited

U.S. PATENT DOCUMENTS

| | | | |
|---|---|---|---|
| 988,109 | 3/1911 | Kaufmann | 403/48 |
| 1,364,599 | 1/1921 | Wilder | 403/43 X |
| 1,517,871 | 12/1924 | Thompson | 404/26 |
| 1,908,909 | 5/1933 | Manz | 52/19 |
| 2,148,783 | 2/1939 | Spaulding | 405/150 |
| 2,346,361 | 4/1944 | Cupido | 404/25 X |
| 2,462,382 | 2/1949 | Gleason | 403/43 |
| 2,605,523 | 8/1952 | Llewellyn | 403/43 X |
| 3,218,943 | 11/1965 | Bowman | 404/26 |
| 3,283,909 | 11/1966 | Daubman | 403/43 X |
| 3,304,954 | 2/1967 | Kaiser | 405/150 X |
| 3,773,428 | 11/1973 | Bowman | 404/26 |
| 3,891,337 | 6/1975 | McCoy | 404/26 |
| 4,097,171 | 6/1978 | Fier | 404/26 |
| 4,225,266 | 9/1980 | Fier | 404/26 |

FOREIGN PATENT DOCUMENTS 394687 12/1965 Switzerland .

*Primary Examiner*—Nile C. Byers, Jr.

*Attorney, Agent, or Firm*—Frease & Bishop

[57] ABSTRACT

A manhole cover support ring adapted to be placed within an existing manhole frame for raising the height of a manhole cover. A circular ring is formed by a generally vertically extending flange having an annular bar welded on its lower end which provides an inwardly extending manhole cover support ledge. The flange and bar are split at a common point on their peripheries. An expansion mechanism is pivotally mounted on and extends between the spaced ends of the bar formed by the split in the ring. The expansion mechanism includes a pair of eyebolts pivotally mounted on the spaced ends of the annular bar. The eyebolts each have a threaded shaft which is engaged in a respective threaded end of a tubular member. One of the threaded shafts has a right-hand thread and the other shaft is formed with a left-hand thread, whereby rotation of the tubular member in one direction will contract the ring sufficiently to place it within the manhole frame opening. Rotation of the tubular member in the opposite direction will expand the ring outwardly into abutting relationship with a complementary circular portion of the manhole frame which forms the manhole opening to secure the support ring in the manhole frame. The pivotal mounting of the eyebolts eliminates any bending moments in the threaded connection between the bolts and tubular member, providing a greater range of ring expansion and providing a positive tangential expansion force on the ring.

15 Claims, 9 Drawing Figures

MANHOLE COVER SUPPORT RING

CROSS-REFERENCE TO RELATED PATENT

The subject matter of this invention is an improvement on the manhole cover support ring disclosed in my previously issued U.S. Pat. No. 4,097,171.

BACKGROUND OF THE INVENTION

1. Field of the Invention

The invention relates to manhole cover supports and in particular to a separate ring placed within an existing manhole to raise the height of the manhole cover to compensate for added roadway pavement. More particularly, the invention relates to a manhole cover support ring which is mounted within an existing manhole frame opening and is expanded outwardly into clamping engagement with the manhole cover frame by a pivotally mounted tubular-bolt mechanism on the ring.

2. Description of the Prior Art

Most underground facilities, such as sanitary and storm sewers, utility conduits and the like, have manhole openings to provide access thereto. These manholes usually are located in the street or roadway and consist of an inverted bell-shaped metal frame mounted on top of a brick or concrete base structure. This metal frame has an internal ledge for supporting the manhole cover so that the top of the cover is level with the top of the frame and surrounding roadway pavement.

Problems arise quite frequently in the resurfacing of roadways in that a layer of pavement is placed on the existing pavement, resulting in the manhole cover being below the top surface of the new pavement, causing a depression in the roadway. It is quite difficult and expensive to raise the existing manhole frame sufficiently to compensate for the added pavement.

Various devices have been constructed which enable an existing manhole cover to be raised to the level of the new pavement surface without raising the existing manhole frame. Examples of these devices are shown in U.S. Pat. Nos. 1,517,871, 2,346,361, 3,218,943, 3,773,428 and 3,891,337.

Some of these prior art devices, although apparently providing the desired results, are expensive to manufacture due to the number of machining and forming operations required for their fabrication. Likewise, these devices achieve their adjustment and/or clamping engagement with the manhole frame by a threaded screw mechanism which adjustably joins together a plurality of arcuate ring sections, such as shown in U.S. Pat. Nos. 3,218,943 and 3,773,428. Rotation of the threaded screw or screws expands the ring sections outwardly to achieve the desired clamping engagement with the manhole frame wall.

These types of expansion rings present problems if a large amount of expansion is required in that a bending moment or force is exerted at the engagement point of the adjusting screw and its threaded lug which is mounted on the ring due to the natural tendency of the ring to attempt to conform to the circular configuration of the manhole frame wall and the necessary straight line engagement between the adjusting screw threads and the threaded lugs. This bending moment creates considerable binding between the screw and lug of the ring segment and can prevent sufficient rotation of the screw required to securely clamp the support ring in position on the manhole frame. Also, many of these prior elevating ring constructions use an expanding mechanism which protrudes into the internal diameter of the manhole opening, thereby reducing the actual internal diameter, as well as creating a work and safety hazard for workmen climbing into and out of the manhole opening.

Many of these problems existing with present manhole support rings have been eliminated by the manhole cover support ring shown in my above-mentioned U.S. Pat. No. 4,097,171. Although the support ring construction of this patent performs satisfactorily, it can create an undesirable situation in that the toggle links of the expansion mechanism occasionally become damaged during storage and shipment, since the links flap loosely on their pivotal mounting since they are not connected together. Also, the range of hole sizes is somewhat limited in which this toggle-actuated ring construction can be used. Occasionally the toggle links when in an open position, may form too sharp of an angle between the engaged link ends, making it extremely difficult to move the junction point outwardly beyond center to lock the ring in position since this sharp angle requires a large amount of force. Therefore, my improved ring construction which is discussed below and defined in the claims, overcomes the problems existing with prior constructions, including the ring construction of my previous patent.

No manhole cover support ring of which I am aware uses an internal, peripherally mounted, tubular-bolt-actuated mechanism for expanding the support ring outwardly into clamping arrangement within the opening of a manhole frame without placing an undesirable bending moment on the expanding screws or bolts.

SUMMARY OF THE INVENTION

Objectives of the invention include providing a manhole cover support ring formed relatively inexpensively of a flat strip of metal and a strip of rectangular bar stock which is welded on the lower end of the strip, both of which then are formed into a circular configuration with a gap existing between the adjacent spaced ends, and in which an improved expanding mechanism is pivotally mounted on and operatively engageable with the spaced end portions of the ring to forcibly expand the ring outwardly into engagement with the sides of an existing manhole opening frame; providing such a support ring in which the expansion mechanism is expanded outwardly by rotating a tubular member by a drift pin or other type of manually operated wrench or hand tool after the ring has been placed into the existing manhole frame opening; providing such an improved support ring in which the expansion mechanism lies generally within the periphery of the ring eliminating any components from protruding excessively into the internal diameter of the manhole opening, thereby eliminating a work and safety hazard and maintaining the effective internal diameter of the manhole opening; providing such an improved support ring in which the expansion mechanism is formed by a pair of eyebolts, each of which is pivotally mounted on a respective end of the split ring, with an internally threaded tubular member operatively engaged with the threaded ends of the eyebolts for expanding or contracting the support ring; providing such a support ring having an improved expansion mechanism which enables the ring to be used for larger manhole frame opening sizes and smaller diameter holes for a given rolled riser ring than heretofore possible, by eliminating any bending moment or force on the threaded connection of the expansion mechanism due to the pivotal mounting of the eyebolts; providing such a support ring in which the improved expansion mechanism is free of components which hang or flop loosely on the ring during storage, shipment and installation, eliminating damage to the expansion mechanism components as heretofore occurred in prior ring constructions and which allows the ring to be rolled to a mid-range size yet still achieve good curvature contact with the curved walls of the manhole frame opening even when the diameter is expanded or contracted over a relatively large range; and providing an improved manhole cover support ring which is relatively inexpensive, which eliminates difficulties heretofore encountered with prior devices, which achieves the stated objectives simply, effectively and efficiently, and solves problems and satisfies needs existing in the art.

These objectives and advantages are obtained by the improved ring construction for supporting a manhole cover in an elevated position within a manhole frame, the general nature of which may be stated as including circular ring means having inwardly projecting manhole cover supporting ledge means and upwardly extending flange means, said ring means being split at least at one point on its periphery forming a pair of spaced end portions; a pair of bolt means, each being pivotally mounted on a respective end portion of the ring means and extending toward each other; and connector means threadedly engaged with and extending between the pair of bolt means for expanding the ring means outwardly when the connector means is rotated in a first rotational direction to force the flange means into abutting engagement with the manhole frame.

BRIEF DESCRIPTION OF THE DRAWING

A preferred embodiment of the invention—illustrative of the best mode in which applicant has contemplated applying the principles—is set forth in the following description and shown in the accompanying drawing, and is particularly and distinctly pointed out and set forth in the appended claims.

Similar numerals refer to similar parts throughout the drawing.

DESCRIPTION OF THE PREFERRED EMBODIMENT

Figure 1:
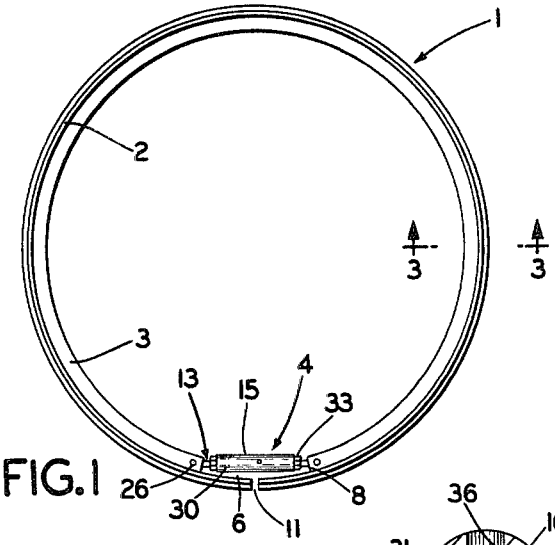
FIG. 1 is a top plan view of the improved manhole cover supporting ring.
Figure 3:
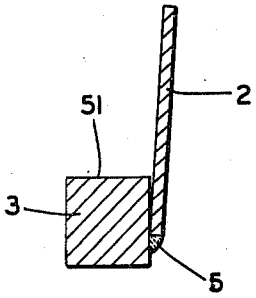
FIG. 3 is an enlarged sectional view taken on line 3—3, FIG. 1.

The improved manhole cover support ring is indicated generally at 1 and is shown in FIG. 1. Ring 1 includes as its main components a generally vertical flange 2, a lower manhole cover support bar 3 and a sleeve expansion mechanism indicated generally at 4. Flange 2 is formed of a relatively flat metal strip with bar 3 being formed from bar stock, preferably having a rectangular cross-sectional configuration. Bar 3 is attached by ends 5 to the bottom portion of flange 2 (FIG. 3). Flange 2 and bar 3 are formed into a circular configuration before or after being welded together as shown in FIG. 1, with bar 3 lying inwardly or inside of the periphery of flange 2.

Figure 2:
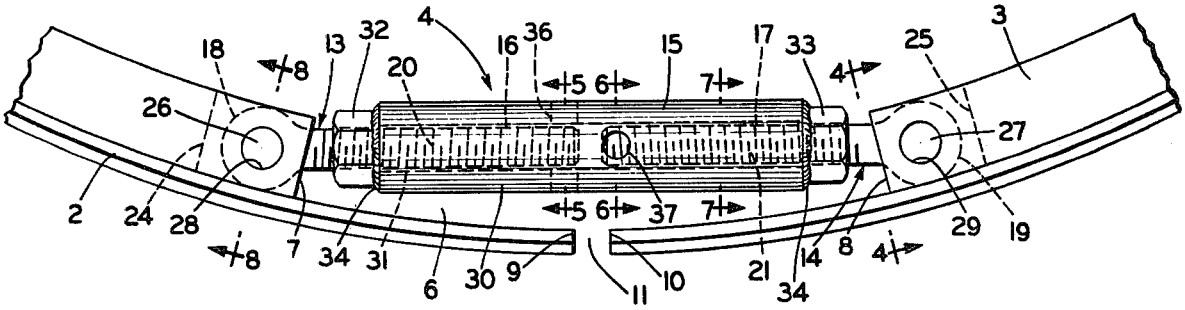
FIG. 2 is an enlarged fragmentary top plan view of the sleeve expansion mechanism of the improved support ring of FIG. 1.

The length of bar 3 is shorter than that of flange 2. This arrangement provides a greater separation or gap 6 between spaced ends 7 and 8 of bar 3 than the separation or gap 11 between spaced ends 9 and 10 of flange 2 when flange 2 and bar 3 are formed into their circular configuration. Enlarged gap 6 provides sufficient space for mounting of expansion mechanism 4 between spaced bar ends 7 and 8, as shown in FIGS. 1 and 2, and still provides support for a manhole cover.

Manhole frames used by most cities and municipalities have a nominal size opening so that the required approximate diameter size of ring 2 is known at time of construction. However, since the manhole frames are not precision formed during their manufacture, the diameter can vary, which necessitates the split ring-expansion mechanism construction of the present invention in order to adapt improved support ring 1 to most applications.

Figure 4:
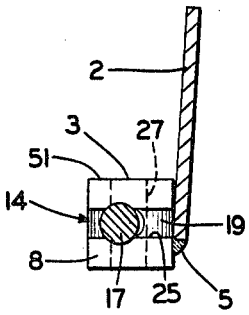
FIG. 4 is a sectional view taken on line 4—4, FIG. 2.

In the event the particular manhole opening in which ring 1 is to be used varies considerably from a standard size, the diameter of ring 1 can be changed accordingly by varying the lengths of flange 2 and bar 3. Flange 2, when assembled with bar 3, preferably extends outwardly from a true vertical position, as shown in FIGS. 3 and 4, forming a frustro-conical configuration.

In accordance with the main feature of the invention, expansion mechanism 4 is mounted on bar 3 and extends across gap 6 between spaced ends 7 and 8. Mechanism 4 (FIGS. 2 and 4–7) includes a pair of eyebolts indicated generally at 13 and 14 threadedly engaged with a tubular member 15. Eyebolts 13 and 14 consist of threaded rods 16 and 17, one end of which is formed with eyelets 18 and 19, with the other ends having threads 20 and 21 formed therealong, respectively.

Figure 8:
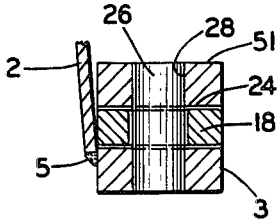
FIG. 8 is an enlarged sectional view taken on line 8—8, FIG. 2.
Figure 5:
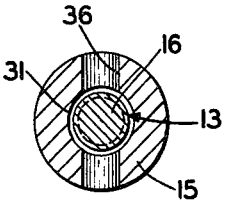
FIG. 5 is an enlarged sectional view taken on line 5—5, FIG. 2.
Figure 6:
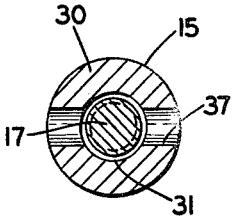
FIG. 6 is an enlarged sectional view taken on line 6—6, FIG. 2.
Figure 7:
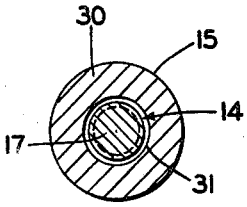
FIG. 7 is an enlarged sectional view taken on line 7—7, FIG. 2.

Eyebolts 13 and 14 are pivotally mounted on the spaced ends 7 and 8 of bar 3 by placement of eyelets 18 and 19 within slots 24 and 25 formed therein (FIG. 8). Pivot pins 26 and 27 extend through vertically aligned holes 28 and 29 formed in bar ends 7 and 8, respectively, and through eyelets 18 and 19, forming a pivotal mounting for expansion mechanism 4. Eyebolts 13 and 14 are similar except that one of the bolts is formed with a right-hand screw thread and the other eyebolt is formed with a left-hand screw thread.

Tubular member 15 includes a cylindrical sleeve 30 having a smooth interior bore 31 which preferably extends throughout the longitudinal length of sleeve 30. A pair of nuts 32 and 33 are attached by welds 34 to the outer ends of sleeve 30 to provide the threaded engagement for threads 20 and 21 of eyebolts 13 and 14, respectively. If desired, tubular member 15 could be formed from a sleeve having a threaded internal bore in contrast to the smooth bore configuration of sleeve 30 in combination with nuts 32 and 33 without affecting the concept of the invention.

A pair of small holes 36 and 37 are formed in cylindrical sleeve 30 and extend diametrically therethrough and are located 180° with respect to each other in sleeve 30. Holes 36 and 37 are formed near the midpoint of sleeve 30 and provide openings for receiving a drift pin or similar tool for applying rotational force on tubular member 15 for expanding or contracting support ring 1.

Figure 9:
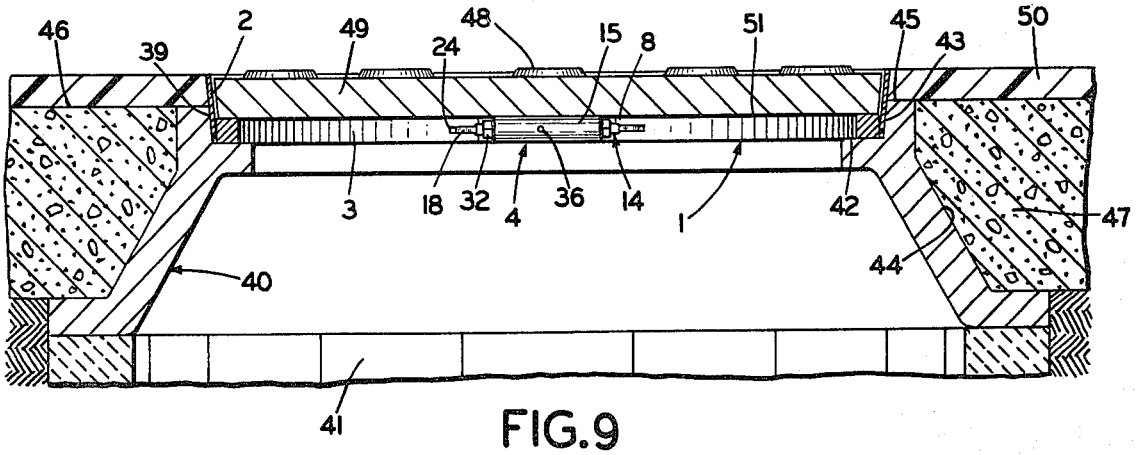
FIG. 9 is a sectional view of the improved manhole cover support ring mounted on an existing manhole frame.

FIG. 9 shows diagrammatically support ring 1 mounted within a usual manhole opening 39. A usual manhole consists of a bell-shaped frame 40 which is mounted on top of a brick water catch basin 41. Frame 40 has an annular horizontal manhole cover supporting ledge 42 which terminates in an upwardly, generally outwardly extending conical wall 43. Wall 43 is connected with outer bell surface 44 by an annular horizontal top surface 45. The top surface 46 of the original road pavement 47 is generally level with top surface 45 of frame 40 and with top surface 48 of manhole cover 49, when cover 49 is supported on horizontal ledge 42 prior to the installation of ring 1.

Ring 1 is shown installed on manhole frame 40 (FIG. 9) with a new layer of asphalt pavement 50 being shown placed on original road pavement 47. Bar 3 rests upon and is supported by manhole frame ledge 42 with flange 3 being in clamped contact with conical wall 43 of manhole frame 40.

When installing ring 1, all dirt, rust and other debris is removed from ledge 42 and conical wall 43 of manhole frame 40. Ring 1 is placed within manhole frame opening 39 which is defined by frame wall 43 after expansion mechanism 4 is rotated to draw spaced ends 7–8 and 9–10 inwardly toward each other to reduce the diameter of ring 1, thereby enabling ring 1 to be placed easily within manhole opening 39. A drift pin or other wrench-type tool then is inserted in hole 36 or 37 to rotate tubular member 15.

Rotational movement of tubular member 15 in one direction will expand ring 1 outwardly by threadedly advancing eyebolts 13 and 14 outwardly from tubular member 15 due to the right-and-left relationship of threads 20 and 21 with respect to nuts 32 and 33. Tubular member 15 is rotated until flange 2 of ring 1 is clamped tightly against frame wall 43. Drift pin holes 36 and 37 provide an opening every 90° to ensure an available hole or opening for receiving a tool to enable sufficient leverage to be achieved for rotating tubular member 15. After the desired clamping engagement is achieved between flange 2 and conical wall 43, manhole cover 49 is placed on top surface 51 of bar 3 in a usual manner with manhole cover top surface 48 now being generally level with the top surface of new pavement layer 50. If desired, sound-deadening and shock-absorbing gaskets of rubber or similar resilient material may be placed on or bonded to top surface 51 of bar 3 or on manhole frame ledge 42.

The pivotal mounting of eyebolts 13 and 14 on ends 7 and 8 of bar 33 ensures that no bending moment or bending force is exerted upon the threaded connection between threaded rods 16–17 and nuts 32–33, as occurs in prior manhole-elevating ring constructions using threaded connections for expanding and clamping the ring against the existing frame. Thus, as ring 1 is expanded outwardly, any change in force direction will be exerted upon and absorbed by pivot pins 26 and 27. The longitudinal length of tubular member 15 may vary to enable a nominal size diameter ring 1 to be used for a range of manhole opening sizes, thereby reducing the amount of inventory of support rings 1 of various diameters required for rapidly filling orders for such rings.

Another of the important features of ring construction 1 is the location of tubular expansion member 4 generally within the periphery of support bar 3 when in installed position within a manhole frame opening, as shown in FIGS. 1 and 2. This arrangement maintains the effective internal diameter of support bar 3 and eliminates any hazardous protrusions in the manhole opening, as present in some prior art constructions. Also, no sharp projections of any type are present due to the smooth cylindrical outer surface of tubular member 15.

When ring 1 is fabricated, it will be assembled in the condition of FIGS. 1 and 2, wherein tubular member 15 is engaged with eyebolts 13 and 14 eliminating any parts which can flop loosely about and become damaged during storage, loading and unloading, and in transit to a job site, as in some prior constructions wherein the expansion mechanism is not operatively connected together and connected to the ring ends at all times.

Accordingly, the improved manhole cover support ring provides a construction which is formed of a few relatively inexpensive and readily available components which are assembled by a usual welding procedure; provides such a construction using a threaded screw-type expansion mechanism for expanding the ring outwardly into secure clamping engagement with an existing manhole frame without reducing the effective internal diameter of the manhole opening and without exerting a bending force or moment at the junction of the threadedly engaged members as the ring expands outwardly; and provides a construction which is simplified, effective and safe in operation, which eliminates difficulties existing in the art and which achieves the stated objectives and solves problems that have existed in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved manhole cover support ring is constructed and used, the characteristics of the construction, and the advantageous, new and useful results obtained; the new and useful structures, devices, elements, arrangements, parts, and combinations, are set forth in the appended claims.

I claim:

1. Ring construction for supporting a manhole cover in an elevated position within a manhole frame including:

(a) circular ring means having inwardly projecting manhole cover supporting ledge means and upwardly extending flange means, said ring means being split at least at one point on its periphery forming a pair of spaced end portions;

(b) a pair of bolt means, each being pivotally mounted on a respective end portion of the ring means and extending toward each other within the periphery of the ring means; and (c) connector means threadedly engaged with and extending between the pair of bolt means for expanding the ring means outwardly when the connector means is rotated in a first rotational direction to force the flange means into abutting engagement with the manhole frame and for contracting the ring means inwardly when the connector means is rotated in a second rotational direction enabling the ring means to be placed within the manhole frame.

2. The ring construction defined in claim 1 in which the connector means is a tubular member having a central bore terminating in a pair of end openings; in which a portion of the bore has threads formed therein; and in which each of the bolt means extends into the bore through a respective end opening and is threadedly engaged with the bore threads.

3. The ring construction defined in claim 2 in which the tubular member includes a cylindrical-shaped sleeve having a smooth internal bore; and in which a nut is attached to each end of the sleeve providing the bore threads for threadedly engaging the bolt means.

4. The ring construction defined in claim 2 in which a plurality of radially extending holes are formed in the tubular member for receiving an end of a tool for rotating said tubular member and expanding the ring outwardly.

5. The ring construction defined in claim 1 in which each of the bolt means is an eyebolt having a threaded shank and an eyelet; and in which pin means extends through the eyelet of each eyebolt and through an opening formed in each of the end portions of the ring means to pivotally mount the eyebolts on said ring means.

6. The ring construction defined in claim 5 in which a slot is formed in each of the ring means and portions; and in which the eyelets of the eyebolts are pivotally mounted in said slots.

7. The ring construction defined in claim 6 in which the slots are formed in the bar of the ring means.

8. The ring construction defined in claim 1 in which the connector means and bolt means extend in a chordlike manner between the end portions of the ring means with respect to the periphery of the flange means.

9. The ring construction defined in claim 1 in which one of the bolt means has left-hand threads and the other of the bolt means has right-hand threads.

10. In an improved ring construction of the type having a circular ring which is split at least at one point on its periphery forming a pair of spaced ends, for supporting a manhole cover in an elevated position within a manhole frame, wherein improvement includes:

(a) a pair of bolt means, each being pivotally mounted on a respective end of the ring and extending toward each other in a chordlike manner within the periphery of the circular ring; and (b) connector means threadedly engaged with and extending between the pair of bolt means for expanding the ring outwardly when the connector means is rotated in a first rotational direction to force the ring into abutting engagement with the manhole frame and for contacting the ring means inwardly when the connector means is rotated in a second rotational direction enabling the ring means to be placed within the manhole frame.

11. The improved ring construction defined in claim 10 in which the connector means is a tubular member having a central bore terminating in a pair of end openings; in which a portion of the bore has threads formed therein; and in which each of the bolt means extends into the bore through a respective end opening and is threadedly engaged with the bore threads.

12. The improved ring construction defined in claim 11 in which the tubular member includes a cylindrical-shaped sleeve having a smooth internal bore; and in which a nut is attached to each end of the sleeve providing the bore threads for threadedly engaging the bolt means.

13. The improved ring construction defined in claim 11 in which a plurality of radially extending holes are formed in the tubular member for receiving an end of a tool for rotating said tubular member and expanding the ring outwardly.

14. The improved ring construction defined in claim 10 in which each of the bolt means is an eyebolt having a threaded shank and an eyelet; and in which a pin extends through the eyelet of each eyebolt and through an opening formed in a respective end of the ring to pivotally mount the eyebolts on said ring.

15. The improved ring construction defined in claim 10 in which one of the bolt means has left-hand threads and the other of the bolt means has right-hand threads.

* * * * *

UNITED STATES PATENT AND TRADEMARK OFFICE

CERTIFICATE OF CORRECTION

PATENT NO. : 4,302,126

DATED : November 24, 1981

INVENTOR(S) : RAYMOND L. FIER

It is certified that error appears in the above-identified patent and that said Letters Patent are hereby corrected as shown below:

Column 5, line 56, change numeral "33" to - 3 -;

Column 5, line 61, insert - manhole - after "existing";

Column 7, line 34 (in Claim 6), change the word "and" to read - end - ;

Column 8, line 5 (in Claim 10), insert - the - after the word "wherein" ;

Column 8, line 15 (in Claim 10), change "contacting" to read - contracting - .

Signed and Sealed this

Ninth Day of February 1982

[SEAL]

Attest:

GERALD J. MOSSINGHOFF

Attesting Officer

Commissioner of Patents and Trademarks